United States Patent [19]

Fuchs

[11] Patent Number: 4,757,251

[45] Date of Patent: Jul. 12, 1988

[54] CIRCUIT ARRANGEMENT FOR HIGH-VOLTAGE ADJUSTMENT

[75] Inventor: Peter T. Fuchs, Quickborn, Fed. Rep. of Germany

[73] Assignee: U.S. Philips Corporation, New York, N.Y.

[21] Appl. No.: 4,924

[22] Filed: Jan. 20, 1987

[30] Foreign Application Priority Data

Jan. 23, 1986 [DE] Fed. Rep. of Germany ..... 3601857

[51] Int. Cl.[4] ..... G05F 1/44

[52] U.S. Cl. ..... 323/268; 323/271; 323/284; 323/285; 363/72

[58] Field of Search ..... 323/268, 271, 282, 284, 323/222, 276, 285, 270; 363/72

[56] References Cited

U.S. PATENT DOCUMENTS 3,377,539 4/1968 Bates ..... 363/72
3,623,140 11/1971 Nercessian ..... 323/268
3,970,900 7/1976 Hodgins ..... 323/276 X
4,174,534 11/1979 Kotlarewsky ..... 363/72 X
4,514,679 4/1985 Schierjott ..... 323/285 X
4,584,517 4/1986 Schwob ..... 323/222

FOREIGN PATENT DOCUMENTS 3116609 12/1982 Fed. Rep. of Germany ..... 323/268
0426224 10/1974 U.S.S.R. ..... 323/268

*Primary Examiner*—Peter S. Wong
*Assistant Examiner*—Kristine Peckman
*Attorney, Agent, or Firm*—Jack E. Haken

[57] ABSTRACT

The invention relates to a circuit arrangement for adjusting a high voltage. According to the invention, several semiconductor adjustment members are connected in series, only one of the adjustment members being directly coupled to a control signal source, while the control voltage for the remaining adjustment members is each time derived from the output voltage of the preceding adjustment member.

6 Claims, 2 Drawing Sheets

CIRCUIT ARRANGEMENT FOR HIGH-VOLTAGE ADJUSTMENT

The invention relates to a circuit arrangement for high-voltage adjustment with a control path, whose conductivity can be controlled by a voltage supplied by a control voltage source at a control input.

Figure 1:
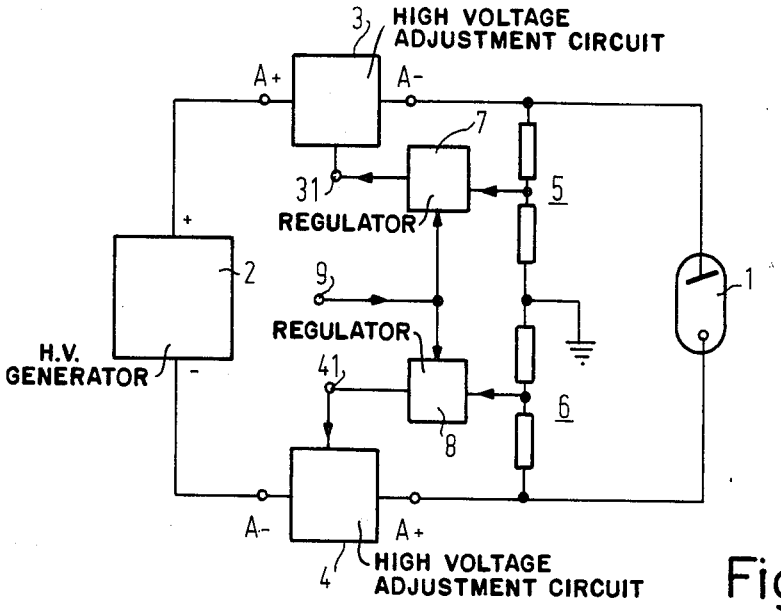
Fig.1 PRIOR ART

Such a circuit arrangement is known from the magazine "Electromedica", 4–5/1973, page 178, which, in FIG. 1, shows an X-ray generator, the control path of which comprises either a control triode or a control tetrode. However, such control triodes are expensive and their filaments have a limited lifetime. If instead semiconductor adjustment members, which have an unlimited lifetime are used, several adjustment members must be connected in series because of their lower tolerance to high-voltage. Each adjustment member would then require a control voltage source, which would have to supply control signals at high-voltage potential. Such control voltage sources generally comprise an insulating transmission element, for example in the form of an optical conductor path or an insulation transformer, and are comparatively expensive.

The present invention has for its object to construct a circuit arrangement comprising several semiconductor adjustment members which does not require a separate control voltage source for each adjustment member.

Starting from a circuit arrangement of the kind mentioned in the opening paragraph, this object is achieved in that several adjustment members are connected in series. Each member comprises between its output terminals a semiconductor element whose conductivity can be controlled in dependence upon the difference between an actual value derived from the output voltage of the adjustment member and a nominal value at a control input of the adjustment member. The control voltage source is coupled to the control input of a first of the adjustment members. Starting from this first member, the nominal value for the succeeding adjustment member is derived from the output voltage of another adjustment member.

The semiconductor adjustment members thus each comprise a control circuit, which produces at the output terminals, by control of the semiconductor path, an output voltage which corresponds to the nominal value at the control input of the adjustment member. Each of the nominal values are derived from the output voltages of the preceding adjustment members in the series arrangement and a control voltage has only to be supplied to the first adjustment member.

The larger the number of adjustment members controlled by a control voltage source, the larger the voltage sweep that can be obtained therewith. But the component rejection probability is also higher rejection probability and the adjustment speed is lower. Therefore, it is not efficient in practice to control an arbitrary number of adjustment members by only one control voltage source. Several of the circuit arrangements according to the invention are connected in series—and a separate control voltage source is provided for each of these circuits arrangements. In this case the high-voltage adjustment range that can be obtained with a number of adjustment members limited to a maximum can be sufficiently large.

In different applications it is possible that the high-voltage load may be transiently shortcircuited. In an X-ray generator case, for example, with an arc-through of the X-ray tube. In order to avoid an overload of the adjustment members, a further embodiment of the invention is characterized in that a voltage limiting unit is connected in parallel with the semiconductor path.

is possible that the difference between the nominal value and the actual value can supplied to the controllable semiconductor path itself, for example to a transistor, by means of a passive network. In this case, however, a small loop amplification would be obtained and the control error resulting therefrom would be passed on to the next stage. A preferred embodiment is therefore characterized in that each adjustment member comprises a comparison circuit, which supplies an output voltage for controlling the semiconductor path corresponding to the difference between the nominal value and the actual value, and in that the supply voltage for the comparison circuit is derived from the output voltage of the adjustment member. As a result, the control error is kept small without any additional compensation.

Depending upon whether the potential of the preceding adjustment member is more positive or more negative, either an inverting or non-inverting input of such a comparision circuit is coupled to the output terminal of the preceding adjustment member.

Figure 3:
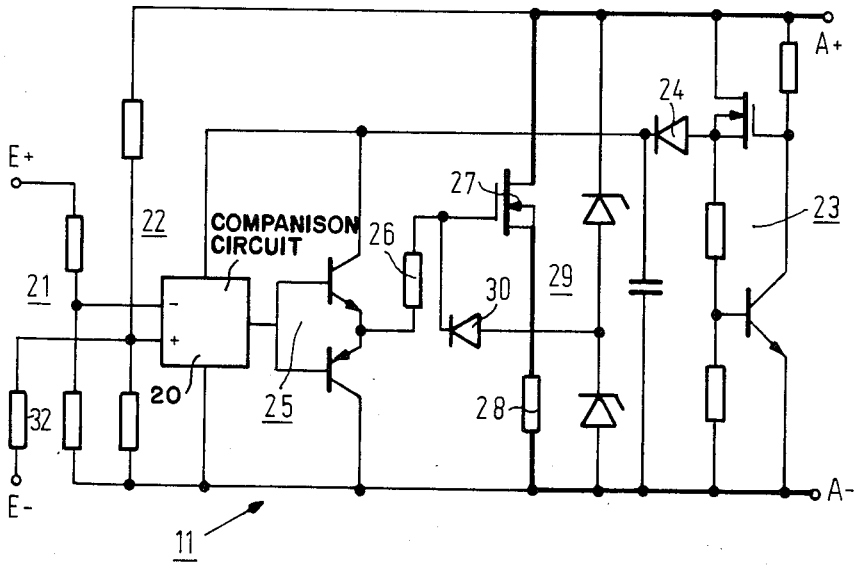
Figure 2A:
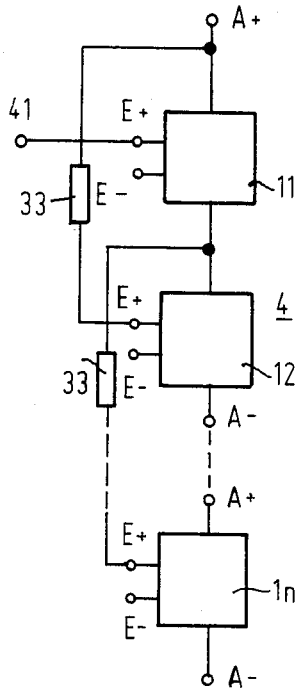
Figure 2B:
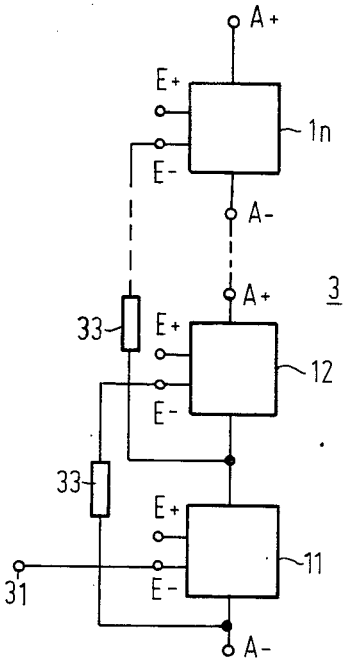

In order that the invention may be readily carried out, it will now be described more fully with reference to the accompanying drawing, in which:

FIG. 1 shows the block circuit diagram of an X-ray generator, in which the invention can be used, FIGS. 2*a* and 2*b* show different connection possibilities of a circuit arrangement according to the invention, and FIG. 3 shows a circuit diagram of an adjustment member suitable for use in such a circuit arrangement.

FIG. 1 shows an X-ray tube 1, whose anode and cathode are each coupled through high-voltage adjustment circuit 3 and 4, respectively, to a high-voltage generator 2. The actual value of the voltage at the anode and cathode, respectively, of the X-ray tube 1 is measured by means of a high-voltage divider 5 and 6, respectively, connected between the anode and the cathode, respectively, on the one hand and earth on the other hand and is compared in regulators 7 and 8, respectively, with a nominal value at the terminal 9. The control deviation is each time supplied to the control inputs 31 and 41, respectively, of the circuits 3 and 4, respectively. As a result, the conductivity of the path between the connections A+ and A− is modified so that the actual values at the high-voltage dividers correspond to the given nominal value.

In principle, this circuit arrangement is known from the magazine "Electromedica", Volume 4-5/1973, page 178, FIG. 1, but in this case the circuits 3 and 4 comprise control triodes, while these circuits are replaced in accordance with the invention by a series of semiconductor adjustment members 11,12 . . . 1*n* (Cf. FIGS. 2*a* and 2*b*). The adjustment members have the construction shown in FIG. 3. Each adjustment member has a comparison circuit 20, having an inverting input which is connected to the tapping on a voltage divider 21. One end of the voltage divider 11 is connected to the negative output terminal A− of the adjustment member and the other end is connected to a second control input E+. The non-inverting input of the comparison circuit 20 is connected to a voltage divider 22, which is connected between the output terminals A+ and A− of the voltage adjustment member (under operating conditions terminal A+ is more positive than than at terminal A−).

The supply voltage for the comparison circuit is produced by a circuit 23 in such a manner that it is practically independent of variations of the voltage between the output terminals A+ and A−. The output of the circuit 23 is connected through a diode 24, polarized in forward direction, to the positive supply voltage connection of the comparison circuit 20 as well as to one end of a capacitor, C. The other end of the capacitor is connected to the negative output terminal A−, to as is the negative supply voltage connection of the comparison circuit 20. The direct voltage thus produced at the voltage supply of the comparison circuit 20 is, for example, 10 V as long as the output voltage is only so large that this direct voltage value can be derived therefrom by means of the circuit 23.

The output of the comparison circuit 20 is connected through a driver stage 25 and a comparatively small resistor 26 (for example 1 kΩ) to the gate connection of a semi conductor element such as a MOS field effect transistor 27 of the N-channel depletion type. The drain connection of this transistor is connected to the positive output terminal A+, while the source connection of this transistor is connected through a small resistor 28 to the negative output terminal A− of the adjustment member. Practically all the current from the high-voltage generator 2 to the high-voltage load (X-ray tube 1) flows through this field effect transistor. This transistor must therefore be a power transistor with a high cut-off voltage, which is capable of conveying a high direct current. If the current of the transistor admissible with this voltage is too small, several of such field effect transistors can be connected in parallel with the electrodes corresponding to each other.

A voltage limiting circuit in the form of a Zener diode path 29 is connected between the output terminals A+ and A− and a tapping of this path is connected through a diode 30 to the gate connection of the field effect transistor 27. In the case of a tube control, the X-ray tube 1 may occasionally transiently represent a shortcircuit. In such a case, the voltage drop at the adjustment member would be limited to a maximum value by the Zener diode 29, while an increased current would flow—transiently—through the field effect transistor due to the variation of its bias voltage via the diode 30.

The adjustment member shown in FIG. 3 causes the conductivity of the transistor 27 and hence the voltage drop between the output terminals A+ and A− to change in such a manner that the voltage between the inverting input and the non-inverting input of the comparison circuit 20 each time becomes zero. Consequently, the voltage drop between the terminals A+ and A− can be controlled by the voltage at the control input E+ or at a control input E−, which is connected through a resistor 32 to the non-inverting input of the comparison circuit 20.

In FIGS. 2*a* and 2*b*, the adjustment members 11,12 . . . 1*n* are connected in series in such a manner that the negative output connection A− of an adjustment member is connected to the positive output connection A+ of an adjacent adjustment member. Consequently, the overall voltage between the high-voltage generator and the high-voltage load is distributed uniformly over the individual adjustment members. According to FIG. 2*a*, the adjustment member 11, whose high-voltage potential is lowest, is connected through its control input E+ to the output 41 of the control voltage source 8. Therefore, a voltage drop is produced between the output terminals A+ and A− of this adjustment member and this voltage drop linearly depends upon the potential at the connection 41.

The output connection A+ of this adjustment member is also connected through a resistor 33 to the control input E+ of the succeeding adjustment member 12. The nominal value for the adjustment member 12 is consequently derived from the output voltage of the adjustment member 11. However, since this voltage corresponds to the nominal value at its input E+ and at the input 41, respectively, the voltage at the input E+ also corresponds to the voltage at the connection 41. Consequently, the voltage drop at the adjustment member 12 follows the voltage drop at the adjustment member 11.

The voltage at the output terminal A+ of the adjustment member 12 is supplied again through a further resistor 33 to the input E+ of the succeeding adjustment member, from whose output voltage the nominal value of the succeeding adjustment member is derived again, and so on, until finally the output terminal A+ of the last adjustment member but one in the series is connected to the control input E+ of the last adjustment member 1*n*. Subsequently, all adjustment members—on the assumption that the construction is the same—have between their output terminals the same voltage drop, which is determined by the potential at the connection 41.

The circuit 3 shown in FIG. 2*b* is distinguished from the circuit 4 in FIG. 2*a* solely in that the control connection 31 is connected to the control input E− of the adjustment member 11, which is applied to the lowest high-voltage potential, and in that the nominal value for the remaining adjustment members 12 . . . 1*n* is supplied to the control input E− and is derived from the voltage at the output A− of the preceding adjustment member.

While in the case of the circuit of FIG. 2*a* the comparison is effected in dependence upon the proportioning of the voltage divider 22, but at a voltage which lies a few volts above the voltage at the output terminal A−, the voltage comparison in the case of the circuit of FIG. 2*b* is effected at the potential of the output connection A−, which at the same time constitutes a voltage supply connection of the circuit 20. The latter must therefore be designed so that it can carry out a voltage comparison down to the potential at its negative direct voltage supply connection.

It was assumed above that a number of semiconductor adjustment members are connected in series as required for the realization of the necessary high-voltage adjustment range. However, in practice it is not efficient to arrange too large a number of such adjustment members consecutively because the rejection probability becomes higher as the number of adjustment members in the chain is larger and because the adjustment speed decreases with an increasing number of adjustment members. In order to avoid that the chain of adjustment members becomes too long, it may therefore be useful to connect in series two or more circuits of the kind shown in FIG. 2*a* or FIG. 2*b*. For each of these circuits, a separate control voltage source and a separate tap on the high-voltage divider then have to be provided.

In the arrangement shown in FIG. 1, the circuits 3 and 4 are connected in series with the high-voltage load. If the high-voltage generator 2 has a sufficiently high internal resistance, they may also be connected in parallel with the high-voltage load, that is to say connected between anode and cathode, respectively, on the one hand and earth on the other hand. In this case, the high-voltage drop to be processed at the adjustment members would be larger, but only a part of the current through the high-voltage load would flow through the adjustment members.

In the circuits shown in FIGS. 2*a* and 2*b*, the connection 31 and 41, respectively, of the control voltage source is each time connected to a control input of the adjustment member, which is the first member and the last member, respectivly, in the chain and has the lowest operating potential. If the control input is to an adjustment member in the middle of the chain, the adjustment members following in the direction of the more positive potential would have to be connected through their control input E− to the output A− of each preceding adjustment member, while the members following in the direction of the negative potential have to be connected through their control input E+ to the control input A+ of the preceding adjustment member.

What is claimed is:

1. A circuit for supplying a high voltage to a load comprising:

a source of high voltage;

adjusting means, connected in a series circuit with the source of high voltage and the load, which control the voltage across the load in response to a control voltage input by varying the conductivity of said series circuit between the voltage source and the load; wherein, as an improvement said adjusting means comprise a plurality of adjustment member means which are connected to each other as a series string, each of said adjustment member means including an input terminal for receiving a first voltage, two output terminals, and a series semiconductor element which is functionally connected between said output terminals and whose conductivity varies as a function of the difference between said first voltage and a second voltage which is proportional to a voltage which is actually present between said output terminals, the input terminal of a first of said adjustment member means being connected to said control voltage input, and further comprising means which respectively connect the input terminal of each of the remaining adjustment member means to a signal which is derived from the voltage which is actually present between the output terminals of an adjacent adjusting member means in said series string.

2. The circuit of claim 1 further comprising voltage limiting means functionally connected in parallel with each of said series semiconductor elements.

3. The circuit of claim 1 wherein each adjustment member means comprises a comparison circuit having differential inputs which are connected respectively to the input terminal and the second voltage and an output which is connected to a control input of the series semiconductor element.

4. The circuit of claim 1, 2, or 3 wherein each of said series semiconductor elements is a MOS field effect transistor.

5. The circuit of claim 1 wherein each adjusting member means comprises a voltage divider connected between its output terminals to derive said second voltage.

6. The circuit of claim 1 further comprising a voltage divider connected in parallel with a pair of adjacent adjusting members in said series string wherein the first voltage input of one of the adjusting members in said pair is connected to a tap of said voltage divider.

* * * * *